United States Patent [19]

Keeny

[11] Patent Number: 4,844,316

[45] Date of Patent: Jul. 4, 1989

[54] WEB DIRECTOR

[75] Inventor: Thomas R. Keeny, Lindenwold, N.J.

[73] Assignee: Molins Machine Company, Inc., Cherry Hill, N.J.

[21] Appl. No.: 639,609

[22] Filed: Aug. 10, 1984

Related U.S. Application Data

[63] Continuation-in-part of Ser. No. 511,817, Jul. 8, 1983, abandoned.

[51] Int. Cl.[4] ..... B65H 20/02; B65H 23/28

[52] U.S. Cl. ..... 226/110; 226/196

[58] Field of Search ..... 226/109, 110, 196, 199; 83/105, 106, 107, 302, 425.2, 425.3, 425.4, 443; 242/76; 271/302, 303, 305, 9

[56] References Cited

U.S. PATENT DOCUMENTS

| | | | |
|---|---|---|---|
| 2,251,596 | 8/1941 | O'Malley | 271/303 X |
| 2,500,772 | 3/1950 | Reed | 83/105 |
| 2,668,483 | 2/1954 | Sykes | 271/303 X |
| 3,307,441 | 3/1967 | Saunders et al. | 83/302 |
| 3,489,043 | 1/1970 | Dent | 83/105 X |
| 3,575,331 | 4/1971 | Middleman | 83/105 X |
| 3,831,502 | 8/1974 | Tokuno | 83/302 X |
| 3,831,929 | 8/1974 | Hellmer | 83/106 X |
| 4,041,819 | 8/1977 | Chu et al. | 83/302 |
| 4,194,662 | 3/1980 | Coburn | 226/110 |
| 4,195,539 | 4/1980 | Coburn | 83/106 X |
| 4,214,495 | 7/1980 | Coburn | 83/425.4 |
| 4,328,727 | 5/1982 | Tokuno | 83/106 |
| 4,333,641 | 6/1982 | Peter, III | 271/305 X |

*Primary Examiner*—Harvey C. Hornsby
*Assistant Examiner*—Scott J. Haugland
*Attorney, Agent, or Firm*—Seidel, Gonda, Lavorgna & Monaco

[57] ABSTRACT

The web director is adapted to convey a web of paperboard from a first elevation to a second elevation. A web support is provided having a discrete convex surface and a discrete concave surface arranged so that the web may transfer from one surface to the other. The surfaces have a radius of curvature which facilitates passage of the web of paperboard without breaking.

11 Claims, 2 Drawing Sheets

WEB DIRECTOR

This is a continuation-in-part under 37 CFR 1.62 of prior application Ser. No. 511,817 filed July 8, 1983, now abandoned.

BACKGROUND OF THE INVENTION

A web director per se is known to those skilled in the art of paperboard corrugators. Such web directors are provided immediately upstream of the cut-off machine. For representative samples of such prior art web directors, see U.S. Pat. Nos. 4,194,662 and 3,307,441.

It is believed that all prior web directors have straight surfaces for changing the elevation of a web. In actual practice, there is a limit to the angle of the web support with respect to the horizontal, beyond which the web will break. Thus, the aforementioned angle should generally not be more than about six degrees. U.S. Pat. No. 4,328,727 states that the angle should not be more than 7°. This limitation determines the length of floor space needed for the web director. As the difference in elevation for movement of the web increases, the length of the web director must also increase so that said angle is not more than about 6°. The solution for minimizing floor space set forth in the last mentioned patent is substantially different from that set forth hereinafter.

The present invention is directed to solution of the problem of how to decrease the length of the web director without breaking the web of paperboard and thereby reducing the length of corrugator floor space needed for the web director.

SUMMARY OF THE INVENTION

The present invention is directed to apparatus for conveying a web of paperboard and includes means for supporting the web as the web changes from a first elevation to a second elevation. A rigid web support is provided having a rigid concave surface and a rigid convex surface arranged so that the web may transfer from one to the other. Said surfaces have a radius of curvature which facilitates passage of the web of paperboard without breaking. Each of said surfaces has a terminal end. The terminal end of the concave surface is at said first elevation. The terminal end of said convex surface is at said second elevation.

It is an object of the present invention to provide a novel web director and method which minimizes the floor space needed in a corrugator while accomplishing this object in a manner which is simple, economical and reliable.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
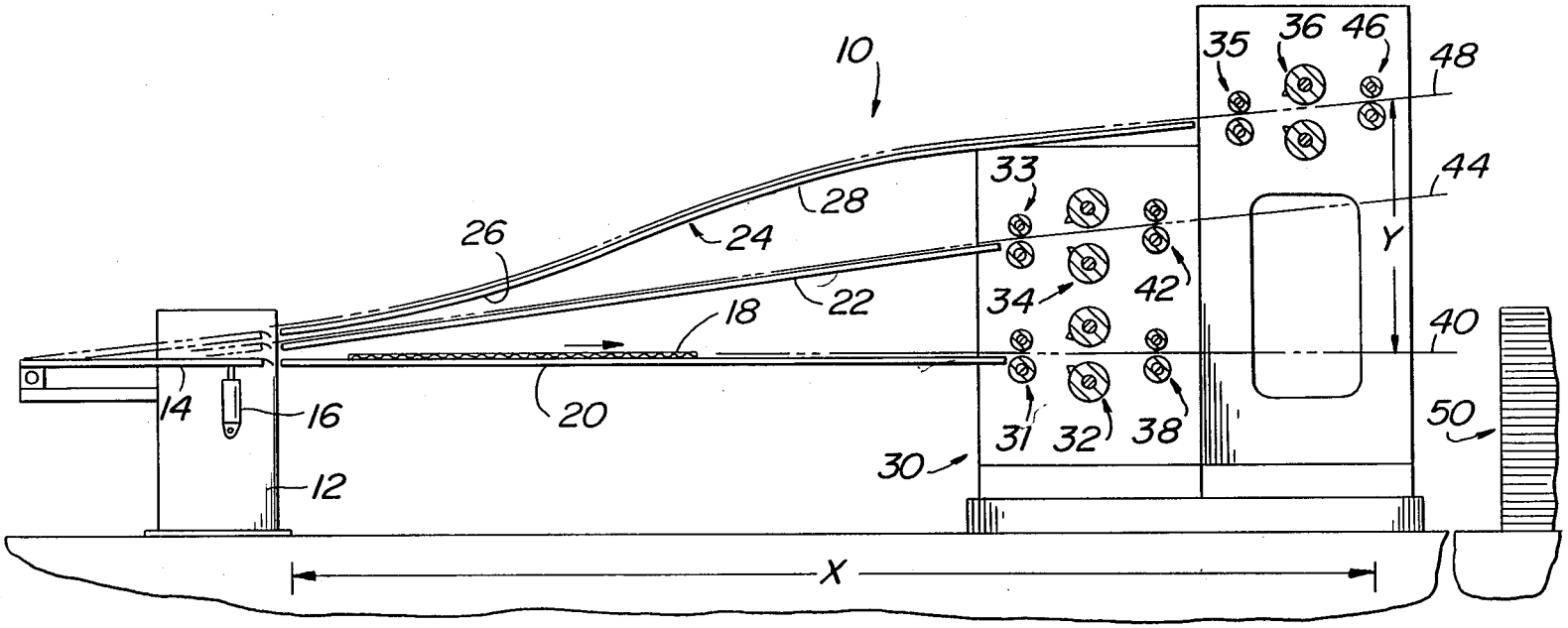
FIG. 1 is a side elevation view of a first embodiment of the present invention.

Referring to the drawing in detail, wherein like numerals indicate like elements, there is shown in FIG. 1 a web director in accordance with the present invention designated generally as 10. The web director 10 includes a frame 12 downstream from a slitter/scorer and upstream from a cutoff machine. A diverter 14 is pivotably supported by the frame 12 and movable to position its downstream end at a plurality of different elevations. In its lowermost position as shown in solid lines in FIG. 1, and with a web 18 moving from left to right, the web 18 is diverted onto a first horizontally disposed web support 20. Motor 16 may position the downstream end of diverter 14 to an intermediate position wherein web 18 is diverted to an intermediate web support 22. Web support 22 is inclined at an angle of about 6° with respect to the horizontal. Motor 16 may position the downstream end of diverter 14 so as to direct the web 18 onto a third or upper web support 24. Web support 24 has a rigid concave portion 26 and a rigid convex portion 28 arranged so that the web 18 may transfer from portion 26 to portion 28 without causing the web 18 to break. A straight line interconnecting the ends of web support 24 forms an angle of about 12° with the horizontal.

The cutoff machine is designated generally as 30 and as illustrated in FIG. 1 has three flow paths. The first flow path is horizontal and corresponds with the elevation of the first web support 20. At that elevation, there is provided a cutter blade means 32 with two sets of drive rollers 31 and 38 upstream and downstream therefrom.

The cutoff machine 30 includes a set of cutter blades 34 with two sets of drive rollers 33 and 42 upstream and downstream therefrom and at the angle of the second support 22. The cutoff machine 30 includes an upper flow path which includes a set of cutter blade means 36 having two sets of drive rollers 35 and 46 upstream and downstream therefrom. As shown in FIG. 1, the middle and upper flowpaths in the cutoff machine 30 are inclined at an angle of about 6° with the horizontal. The sheets leaving drive rollers 38 follow a flow path 40 to a stacker which stacks sheets into a stack 50. From the rollers 42, the sheets follow the flow path 44. From the rollers 46, the sheets follow the flow path 48. The paths 40, 44 and 48 are generally not parallel but are at increasingly greater angles above the horizontal.

When the dimension "Y" is approximately 150 centimeters, and the dimension "X" is approximately 650 centimeters, the radius of curvature for each of the portions 26 and 28 is about 800 centimeters. These dimensions will insure that the web will traverse the curved web support portions 26, 28 without breaking. Also, the dimension "X" is substantially less than the dimension that would be required if the upper web support 24 were straight and at an angle of approximately 6° with respect to the horizontal.

Figure 2:
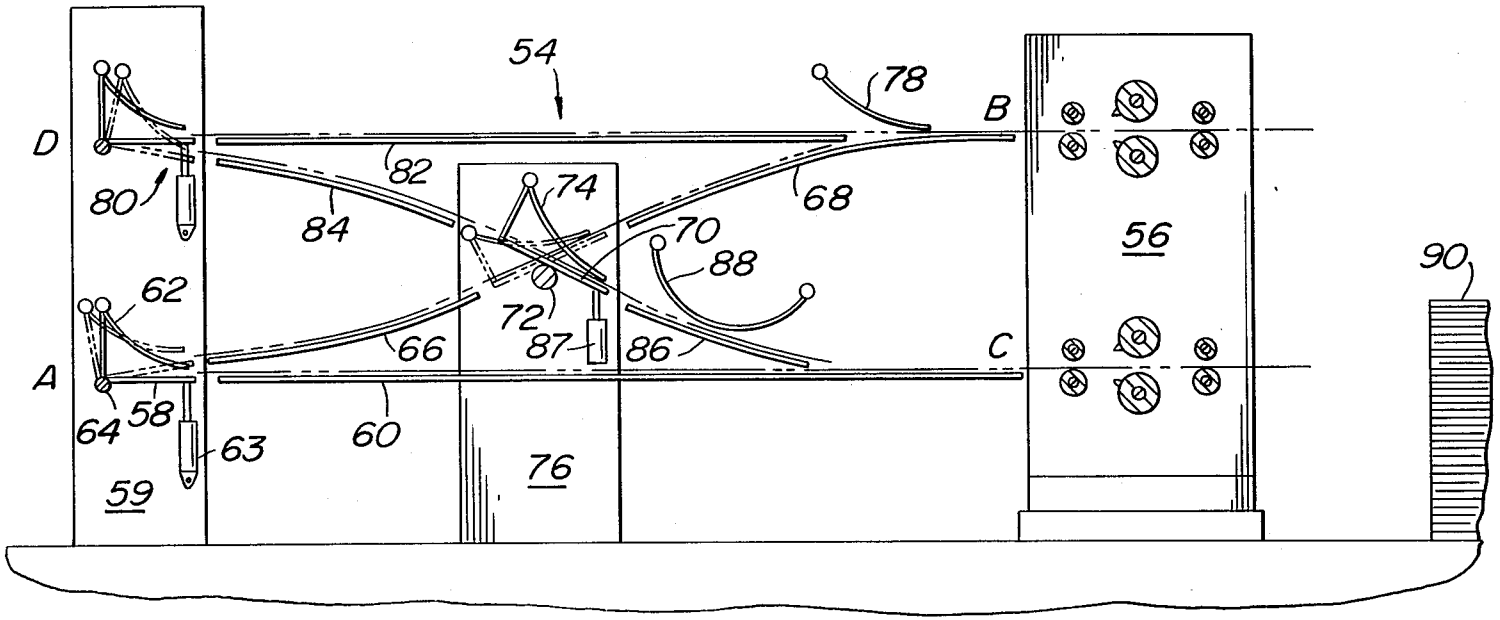
FIG. 2 is a side elevation view of a second embodiment of the present invention.

In FIG. 2, there is illustrated another embodiment of the present invention designated generally as 54. The web director 54 is a multi-level diverter whereby a web of paperboard may be diverted from elevation A to elevation B or C. Also, a web of paperboard may be diverted from elevation D to elevations B or C. Director 54 is particularly adapted for use downstream of a multi-level slitter/scorer such as that disclosed in U.S. Pat. No. 4,214,495.

As shown at the right hand end of FIG. 2, there is provided a dual level cutoff 56 with cutter means at elevations corresponding to elevations B and C. Referring to elevation A, there is provided a diverter 58 supported by frame 59. Diverter 58 is provided with a downwardly curved guide 62 thereabove and connected thereto for simultaneous pivotable movement about shaft 64. In the solid line position of diverter 58, its downstream end is aligned with a horizontally disposed lower web support 60. When the diverter 58 is aligned with support 60, a web of paperboard is diverted from elevation A to elevation C for processing at the lower web path of cutoff machine 56.

A motor 63, such as a double acting pneumatic cylinder, is connected to the diverter 58 for moving the diverter 58 to the phantom position. In the phantom position of diverter 58, a web of paper board is diverted to the concave web support portion 66 and transmitted to the convex web support portion 68 to thereby deliver the web to elevation B. At the transition from web support portion 66 and 68, there is provided a movable straight web diverter 70 mounted on shaft 72. Shaft 72 is supported by frame 76. A downwardly curved guide 74 is connected to the portion 72 and movable therewith. Guides 62 and 74 prevent the web from rising upwardly out of contact with the web support therebelow. A similar guide or hold down strip 78 is supported in any convenient manner adjacent to and above the downstream end of portion 68.

At elevation D, there is provided a diverter 80. Diverter 80 is identical with diverter 58. In the solid line position of diverter 80, it is aligned with an upper web support 82 for transferring a web of paperboard from elevation D to elevation B. In the phantom position of didiverter 80, it directs the web of paperboard to a convex portion 84. Portion 84 is arranged so that the web of paperboard transfers onto the concave portion 86. The diverter 70 is in the gap between portions 84 and 86 and in the gap between portions 66 and 68. By control circuitry not shown, the motor 87, such as a pneumatic cylinder, for moving the diverter 70 is correlated with the motors for diverters 58 and 80. When each of the motors for diverters 58 and 80 is in its lowermost position, the diverter 70 is in its lowermost position. When each of the diverters 58 and 80 is in its uppermost position, diverter 70 is in the phantom position shown in FIG. 2. A hold down strip 88 may be provided above the concave portion 86. The web of paperboard is cut at the cutoff machine 56 in a conventional manner and arranged by a stacker into a stack 90.

In each embodiment of the present invention, it should be noted that there is provided at least one stationary web support having a rigid concave surface and a rigid convex surface arranged so that the web may transfer from one to the other. Each of said surfaces has a fixed terminal end at different elevations.

With the difference in elevation between locations B and C bing approximately 50 centimeters, and the longitudinal distance between locations A and C being approximately 275 centimeters, the radius of curvature of portions 66, 68, 84 and 86 is about 365 centimeters. This construction results in the saving of approximately 200 centimeters of floor space in the corrugator.

The particular radius of curvature used is a function of the rigidity of the web of paperboard. Web director 10 may be used with a rigid triple wall board while web director 54 may be used with a less rigid web such as single wall paperboard. The range of radii of curvature is 3 to 15 meters.

The present invention may be embodied in other specific forms without departing from the spirit or essential attributes thereof and accordingly, reference should be made to the appended claims, rather than to the foregoing specification, as indicating the scope of the invention.

I claim:

1. Apparatus for conveying a web of paperboard including means for supporting the web as the web changes from a first elevation to a second elevation which facilitates passage of the web of paperboard without breaking, said means including a rigid web support preshaped to have a concave surface and a convex surface arranged so that the web may transfer from one surface to the other surface, each of said surfaces having a terminal end, said terminal end of said concave surface being at said first elevation and said terminal end of said convex surface being at said second elevation.

2. Apparatus in accordance with claim 1 wherein the radius of curvature of each of said surfaces is about 3 to 15 meters, and said web support being stationary.

3. Apparatus in accordance with claim 1 including a second convex surface and a second concave surface, said second convex surface being above the elevation of said first mentioned concave surface, said second concave surface being below the elevation of said first mentioned convex surface, and a movable divertor for diverting a web from said first mentioned concave surface to said first mentioned convex surface and for diverting a web from said second convex surface to said second concave surface.

4. Apparatus in accordance with claim 3 including a cutoff machine having a web flow path at each of said first and second elevations for receiving a web from said surfaces.

5. Apparatus in accordance with claim 1 including a horizontal web support beneath said surfaces, a diverter upstream from said horizontal web support and movable for directing a web to either said horizontal web support or said concave surface.

6. Apparatus comprising a cutoff machine having three web paths at different elevations, a discrete web support for each of said web paths, a diverter adjacent the upstream end of each web support, said diverter being adapted to direct a web to any one of said web supports, at least one of said web supports having a rigid concave surface adjacent its upstream end and a rigid convex surface to receive a web from said concave surface, each of said convex and concave surfaces having a terminal end at different elevations, at least one of said web supports being horizontally disposed, another of said web supports being at an acute angle not more than about 6° with respect to the horizontal.

7. Apparatus in accordance with claim 6 wherein the radius of curvature of each of said surfaces is between 3 and 15 meters.

8. Apparatus comprising web support means having an inlet end and an outlet end, said inlet end being arranged to receive a web at either of first and second elevations and facilitate discharge of the web at the outlet end to either one of said elevations, said web support means including a rigid concave surface and a rigid convex surface arranged so that a web may transfer from one surface to the other, said surfaces having a radius of curvature which facilitates passage of the web without breaking, each of said surfaces having a fixed terminal end, said fixed terminal end of said concave surface being at said first elevation at the inlet end and said fixed terminal end of said convex surface being at said second elevation at the outlet end.

9. Apparatus in accordance with claim 8 wherein the radius of curvature of said surfaces is between 3–15 meters.

10. A method of forming a web director having plural flow paths with at least one of said flow paths having ends terminating at different elevations and without breaking a web of corrugated paperboard comprising forming said one flow path as a rigid web support preshaped to have a concave web support surface and a convex web support surface with the radius of curvature of samd surfaces being about 3 to 15 meters.

11. A method in accordance with claim 10 including merging the concave surface into the convex surface with a smooth transition.

* * * * *